US007959001B2

(12) United States Patent
Simonek

(10) Patent No.: US 7,959,001 B2
(45) Date of Patent: Jun. 14, 2011

(54) WRAPPING FOR USED CHEWING GUM

(76) Inventor: Miroslav Simonek, Ostrava-Poruba (CZ)

( * ) Notice: Subject to any disclaimer, the term of this patent is extended or adjusted under 35 U.S.C. 154(b) by 1482 days.

(21) Appl. No.: 10/595,118

(22) PCT Filed: Aug. 12, 2004

(86) PCT No.: PCT/CZ2004/000048

§ 371 (c)(1),
(2), (4) Date: Feb. 23, 2006

(87) PCT Pub. No.: WO2005/019068

PCT Pub. Date: Mar. 3, 2005

(65) Prior Publication Data

US 2007/0166429 A1 Jul. 19, 2007

(51) Int. Cl.
*B65D 73/00* (2006.01)

(52) U.S. Cl. ..... 206/496; 206/527; 426/5

(58) Field of Classification Search ..... 426/5; 206/496, 206/527

See application file for complete search history.

(56) References Cited

U.S. PATENT DOCUMENTS

| | | | | | |
|---|---|---|---|---|---|
| 712,087 | A | * | 10/1902 | O'Neill | 206/0.82 |
| 820,067 | A | * | 5/1906 | Richardson | 206/496 |
| 2,432,656 | A | * | 12/1947 | Cook | 131/239 |
| 2,812,891 | A | * | 11/1957 | Carlson et al. | 206/496 |
| 2,990,100 | A | * | 6/1961 | Randak | 383/43 |
| 3,347,450 | A | * | 10/1967 | Godwin | 229/87.2 |
| 4,905,823 | A | * | 3/1990 | Kara | 206/0.82 |
| 2003/0150766 | A1 | | 8/2003 | Smith | |

FOREIGN PATENT DOCUMENTS

| | | | |
|---|---|---|---|
| DE | 29611977 U | | 10/1996 |
| DE | 19546693 C | | 4/1997 |
| EP | 0 642 993 | * | 3/1995 |
| EP | 0 779 040 | * | 12/1995 |

OTHER PUBLICATIONS

EP 0 779 040, Machine Translation, Nov. 1996.*

USPTO translation of Badura EP 0 779 040, Jun. 1997.*

* cited by examiner

*Primary Examiner* — Rena L Dye

*Assistant Examiner* — Chaim Smith

(74) *Attorney, Agent, or Firm* — Oppedahl Patent Law Firm LLC

(57) ABSTRACT

The wrapping for used chewing gum is formed by an upper part (1) and a lower part (2) of identical form and size, applied together by their full surfaces, where both parts (1), (2) are provided with opposite situated vertical pre-scored lines (3) and where parts (1,2) are attached together along their margins partially, from one-third to one-half of the circumference of the parts (1,2).

2 Claims, 1 Drawing Sheet

WRAPPING FOR USED CHEWING GUM

BACKGROUND OF THE INVENTION

1. Field of the Invention

The invention applies to wrapping for used chewing gum and provides easy hygienic and ecological disposal of used chewing gum which improves the environment.

2. Description of Prior Art

Used chewing gum, thrown out in public places, for example on pavements, floors of public buildings, or on grass plots, contributes to the pollution of the environment and substantially diminishes the utility and aesthetic value of public places. Removal of used chewing gum is very problematic, because the gum usually firmly sticks to surfaces upon which they lie.

One known approach for removal of sticky chewing gum from pavements or floors is to use various machines. Typical machines use a dissolving agent or use local cooling to make mechanical releasing easier. High price and high operating costs are among the disadvantages of using such machines. Yet another disadvantage is that cleaning is performed only from time to time.

To try to prevent the above mentioned problems, keepers or owners of publicly open places often use hygienic devices such as small containers, in which an exchangeable insert is pushed in. One disadvantage of those devices is that their usage is limited to placement within buildings, such as banks, hotels, restaurants and the like. This approach does not solve the problem of discarding of used chewing gum in open areas, on pavements and grass plots.

Another known solution is a device that includes many pieces of wrapping paper. Each paper can be ripped off and used as a wrap for a piece of used chewing gum. Disadvantages of this solution are complicated handling, the necessity of using both hands to open the wrapping paper, the need to use bare hands or putting paper on to consumer's lips, paper that may have already been contaminated by having been carried for a long time in one's pocket or in one's bag.

BRIEF SUMMARY OF THE INVENTION

The aforesaid disadvantages are eliminated by the wrapping for used chewing gum according to the invention. The wrapping is formed by upper part and lower part of identical form and size. The two parts are applied together by their full surfaces. Both parts are provided with opposite situated vertical pre-scored lines. The parts are attached partially together along their margins, from one-third to one-half of their circumference.

An advantage of the wrapping for used chewing gum according to the invention is that it is hygienic, simple and practical to use. Only one hand is sufficient for discarding of chewing gum.

Opening the wrapping is performed by depressing with two fingers, and it does not require direct contact between the mouth and hands. It is also of an advantage that the wrapping can be carried in a pocket, purse and the like with already used chewing gum wrapped in the wrapping for subsequent throwing-out into a wastebasket without risk of the gum fouling the pocket, purse, etc. Yet another advantage is from an aesthetic point of view, when form of the wrapping remains kept, therefore it affects as no waste. The main advantage of this invention is that the wrapping allows subsequent ecological disposal of used chewing gum. Even if someone were to throw out the wrapped gum outside the wastebasket, the gum will not stick to the floor or to pavement. Instead, the wrapping can be easily cleaned up by sweeping.

BRIEF DESCRIPTION OF THE DRAWINGS

In the attached drawings there is a schematically shown exemplary embodiment according to the invention.

DETAILED DESCRIPTION OF THE INVENTION

Figure 1:
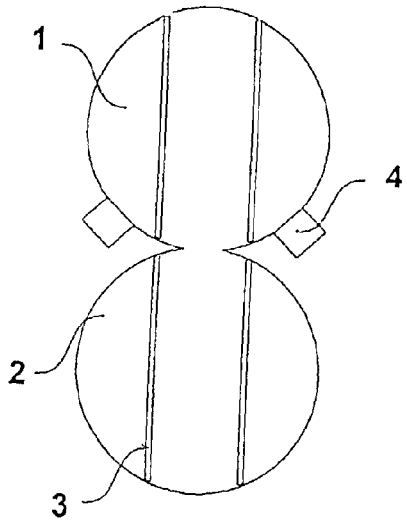
FIG. 1 is a plan view of an expanded wrapping form before assembly and bonding of parts.
Figure 2:
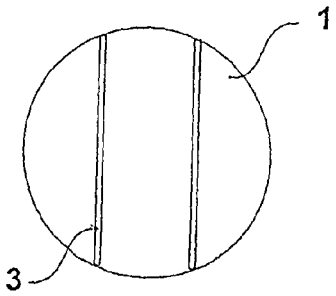
FIG. 2 is a plan view of an assembled and bonded wrapping.
Figure 3:
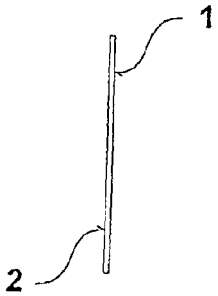
FIG. 3 is a side view.
Figure 4:
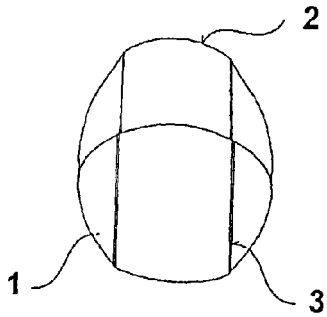
FIG. 4 is a perspective view of the opened, assembled wrapping.

FIG. 1 shows a plan view of an expanded wrapping form before assembly or bonding of parts; the figure showing an upper part, 1, and a lower part, 2, centrally joined together with the upper part having two tabs, 4, extending from its margins and both parts showing vertical crease lines, 3. According to an exemplary embodiment, the wrapping for used chewing gum is formed by the upper part 1 and the lower part 2. Both parts 1, 2 are of circular shape with identical diameter 30 mm and are made from one piece of recycled paper, which had been folded in such a way as to put both parts 1, 2 together with their whole surfaces. Both parts 1, 2 are attached along their margins partially from one-third to one-half of their circumference and are glued and secured together by means of the hidden flaps 4. Both parts 1, 2 are provided with vertical pre-scored lines 3 and the pre-scored lines 3 help to open the wrapping, by depressing two sides of the wrapping with two fingers. Used chewing gum is then spit into the wrapping from the mouth without direct contact with the fingers. Consequently the wrapping is thrown into a wastebasket.

Alternatively, for more aesthetic reason, the circular wrapping can be replaced by a square or rectangular one, alternatively by a wrapping with rounded edges, and furthermore a cylindrical, elliptical, floral or of other shapes. The paper wrapping can be replaced by a wrapping of other material and the parts 1, 2 can be circumferentially bonded by stitching, by a lock or by welding. For easy carrying of the wrapping in a pocket or purse it is advantageous that the wrapping be a coin-sized wrapping.

The wrapping according to the invention can be used for discharging of used chewing gums of all types. It can be attached directly when chewing gum is sold or can be available in restaurants, cultural centers and other places.

The invention claimed is:

1. A used chewing gum wrapping comprising:

an upper part and a lower part of identical form and size, the two parts joining at a center fold, and wherein on either side of the center fold, one tab extends from the margins of the upper part;

each tab is located at a distance from the center fold, wherein the distance of each tab from the center fold is less than or equal to ¼ of the circumference of the upper part;

the upper part and lower part and the lower part are folded together at the center fold;

each of the upper part and lower part having two parallel creases extending linearly through the part and positioned perpendicularly to, and on either side of the center fold;

wherein the two parts are attached together along their margins partially by the center fold and the two tabs, the tabs folding inward towards the center of the upper part and adhering to an opposite position on the lower part;

the opposite position located a like distance from the center fold as the distance of the tab from the center fold; and the adhered configuration characterized in that parts are thereby attached together along their margins partially from one-third to one half of the circumference of the parts, thereby forming the wrapping.

2. A method of disposing used chewing gum using a wrapping: wherein the wrapping comprises:

an upper part and a lower part of identical form and size, the two parts joining at a center fold, and wherein on either side of the center fold, one tab extends from the margins of the upper part;

each tab is located at a distance from the center fold, wherein the distance of each tab from the center fold is less than or equal to ¼ of the circumference of the upper part;

the upper part and lower part and the lower part are folded together at the center fold;

each of the upper part and lower part having two parallel creases extending linearly through the part and positioned perpendicularly to, and on either side of the center fold;

wherein the two parts are attached together along their margins partially by the center fold and the two tabs, the tabs folding inward towards the center of the upper part and adhering to an opposite position on the lower part;

the opposite position located a like distance from the center fold as the distance of the tab from the center fold; and the adhered configuration characterized in that parts are thereby attached together along their margins partially from one-third to one half of the circumference of the parts, thereby forming the wrapping, the method of using the wrapping consisting the steps of:

squeezing two sides of the wrapping with the fingers of one hand, thereby opening the wrapping;

the opening formed by the squeezing characterized by having an aperture width at the edge opposite the attached margin greater than the width between the upper and lower part at points nearer the attached margin;

thereafter, spitting used chewing gum into the wrapping from the mouth without direct contact with the fingers;

thereafter, pressing the upper and lower parts together; and thereafter, discarding the wrapping.

* * * * *